US006154893A

United States Patent [19]

Donnelly

[11] Patent Number: 6,154,893

[45] Date of Patent: Dec. 5, 2000

[54] BRACKET FOR BATHTUBS

[75] Inventor: Steve Donnelly, St. Antoine de Tilly, Canada

[73] Assignee: Maax Inc., Ste-Marie Beauce, Canada

[21] Appl. No.: 09/294,210

[22] Filed: Apr. 20, 1999

[51] Int. Cl.[7] ..... A47K 3/16

[52] U.S. Cl. ..... 4/595; 4/584; 4/632; 4/633; 4/634; 248/213.2

[58] Field of Search ..... 4/595, 584, 632, 4/633, 634; 248/205.1, 213.1, 213.2, 207, 212, 225.21, 223.31, 231.91, 222.11, 222.51, 229.12–229.17, 560, 581, 599, 310, 346.5

[56] References Cited

U.S. PATENT DOCUMENTS

| | | | |
|---|---|---|---|
| 2,938,218 | 5/1960 | Stone | 4/633 |
| 3,210,776 | 10/1965 | Cox | 4/633 |
| 3,585,657 | 6/1971 | Jensen et al. | 4/633 |
| 4,290,154 | 9/1981 | Benjamin . | |
| 4,879,818 | 11/1989 | Murdoch . | |
| 5,182,821 | 2/1993 | Bufford et al. . | |

FOREIGN PATENT DOCUMENTS

| | | | |
|---|---|---|---|
| 656954 | 1/1963 | Canada | 4/633 |

*Primary Examiner*—Steven O. Douglas
*Assistant Examiner*—Khoa Huynh

[57] ABSTRACT

The bracket is to be installed to the inner face of the peripheral rim of a bathtub, to attach the latter to the inner peripheral edge portion of a fixed casing. The bracket has a rigid head portion which is fixedly attached to the inner rim of the bathtub, and a downwardly depending arcuate resilient foot which carries at its lower end a foot. When installing the bathtub inside the casing and more particularly inside the casing peripheral edge portion, the tub is downwardly displaced until its rim comes into downward abutment against the casing peripheral edge portion, the bracket slidingly abutting against the casing peripheral edge portion with a corresponding resilient foot deformation, allowing the foot to slide under the casing peripheral edge portion and to snap itself thereunder for preventing vertical displacement of the bathtub relative to the casing peripheral edge portion. Indeed, the casing peripheral edge portion is then wedged between the bracket foot and the bathtub rim.

3 Claims, 3 Drawing Sheets

BRACKET FOR BATHTUBS

FIELD OF THE INVENTION

The present invention relates to brackets for installing a bathtub to a fixed casing.

BACKGROUND OF THE INVENTION

U.S. Pat. No. 4,290,154 issued in 1981 to W. H. Benjamin shows at FIG. 6 of this patent, a bracket used to fixedly attach the bathtub to a fixed structure, e.g. a wall. The bracket comprises two distinct parts, an apron retaining member and a holding strip. The apron retaining member is fixedly attached to the inner face of the bathtub skirt, and is elbowed so as to be spaced therefrom. The holding strip is nailed to the wall, and comprises an upper rib and a lower upwardly extending finger which forms a channel. The bathtub skirt is to be downwardly inserted inside the channel formed by the holding strip finger, while this same finger is to upwardly engage the space located between the apron retaining member and the bathtub skirt inner face. Thus, the bathtub is fixedly attached to the wall.

The disadvantage of the Benjamin attachment method is that it is complex in that the relationship between the different parts of the bracket are cumbersome to assemble.

OBJECT OF THE INVENTION

It is an object of the present invention to provide a bracket for assembling a bathtub to a fixed casing in a simple manner.

SUMMARY OF THE INVENTION

The present invention relates to brackets for installing a bathtub to a fixed casing.

More particularly, the invention relates to a bathtub bracket for attaching a bathtub to a fixed casing inner peripheral edge portion, the bathtub of the type having a main body and an outer peripheral rim located adjacent and over said casing peripheral edge portion, said bracket comprising:

a rigid head portion for fixed complementary attachment to said bathtub peripheral rim;

a resilient main body integrally downwardly depending from said head portion and carrying a rigid foot having a free tip portion;

wherein said main body can be resiliently forcibly deformed against its own resiliency when the bathtub rim, carrying said bracket, is displaced downwardly towards the casing peripheral edge portion, for moving said foot tip portion around the casing peripheral edge portion, and wherein said main body is to be resiliently released when said foot tip portion vertically downwardly clears the casing peripheral edge portion so as to position said hooking foot tip portion under the casing peripheral edge portion, with the bathtub rim simultaneously downwardly abutting on the casing peripheral edge portion, thus effectively wedging the fixed casing peripheral edge portion between the bathtub rim and the bracket foot tip portion to positively interlock the bathtub to the casing peripheral edge portion and prevent vertical displacement of the bathtub.

The invention further relates to a bathtub and a bathtub bracket for attaching said bathtub to a fixed casing inner peripheral edge portion, the bathtub having a main body and an outer peripheral rim to be located adjacent and over said casing peripheral edge portion, said bracket comprising:

a rigid head portion fixedly attached in a complementary fashion to said bathtub peripheral rim;

a resilient main body integrally downwardly depending from said head portion and carrying a rigid foot having a free tip portion;

wherein said main body can be resiliently forcibly deformed against its own resiliency when said bathtub rim, carrying said bracket, is displaced downwardly towards the casing peripheral edge portion, for moving said hooking foot tip portion around the casing peripheral edge portion, and wherein said main body is to be resiliently released when said foot tip portion vertically downwardly clears the casing peripheral edge portion or positioning said foot tip portion under the casing peripheral edge portion, with the bathtub rim simultaneously downwardly abutting on the casing peripheral edge portion, thus effectively wedging the fixed casing peripheral edge portion between the bathtub rim and the bracket foot tip portion to positively interlock said bathtub to the casing peripheral edge portion and prevent vertical displacement of the bathtub.

The invention also relates to a connector element for positively interconnecting the top peripheral arcuate rim portion of a bathtub to a flat horizontal raised wall from an external anchor element, the bathtub of the type having a flooring and integral peripheral upwardly outwardly inclined wall with a top outwardly downwardly arcuate rim portion, the anchor element flat wall of the type having a free edge portion and top and bottom horizontal wall surfaces; this arcuate rim portion forming a generally concave underface; wherein said connector element comprises:

a) a rigid elongated head, having one end portion of a shape complementary to that of the rim portion concave underface so as to be able to snugly fit thereagainst, spacedly from the top wall surface of the anchor element flat wall free edge portion;

b) a rigid elongated foot, said foot having one end portion sized to fit onto and abut against the bottom wall surface of the anchor element flat wall free edge portion; and c) a resilient arcuate main body, resiliently bridging intermediate sections of said rigid head and said rigid foot spacedly from one another, wherein a jaw member is formed with said head one end portion and said flat foot one end;

wherein said jaw member is sized for through engagement therein of a section of the anchor element flat wall free edge portion with concurrent deformation of said resilient main body yieldingly under concurrent abutment of both said connector element flat head against the bathtub rim portion underface wall and said connector element flat foot against the anchor element flat wall free edge portion bottom wall surface, wherein resilient positive interlock occurs between the bathub rim and the anchor element.

DETAILED DESCRIPTION OF THE EMBODIMENTS

Figure 1:
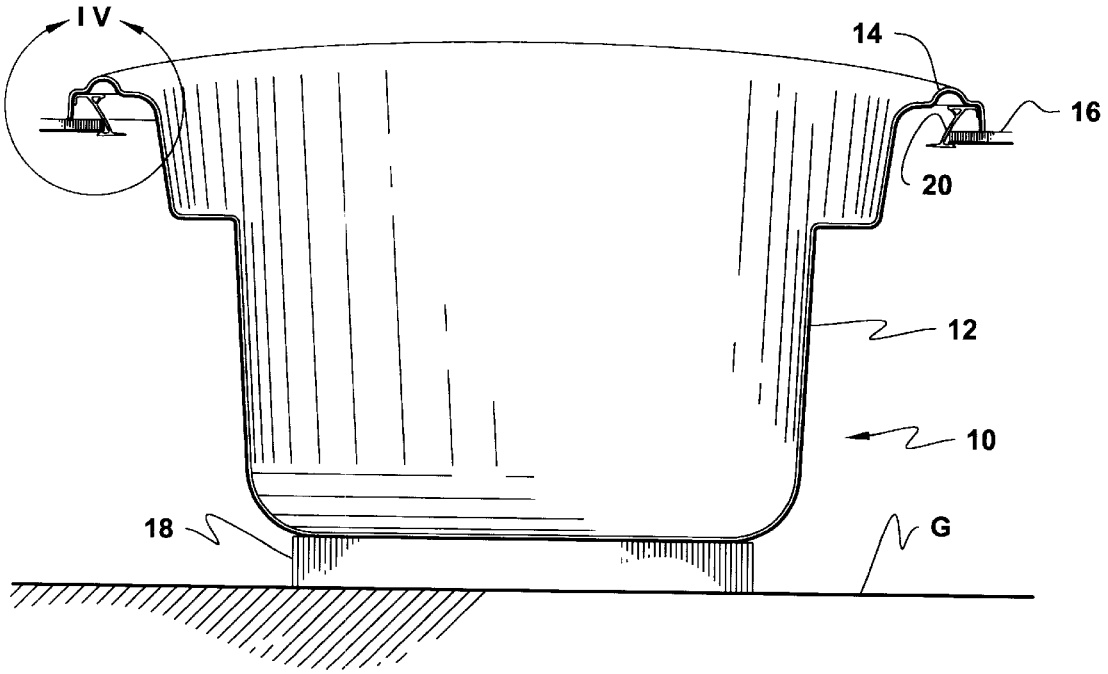
FIG. 1 is a cross-sectional elevation of a bathtub attached to a fixed anchor element with brackets according to the present invention.

FIG. 1 shows a bathtub 10 of conventional configuration, i.e. having a main hollow body 12 to be filled with water. Body 12 is provided with a flooring and an integral peripheral upwardly outwardly inclined wall with a top, outturned, downwardly depending peripheral rim 14 which has an inner concave underface. Rim 14 transversely rests adjacent and over a fixed casing peripheral flat edge portion 16. The casing (not shown) may be of various types, for example a self-standing podium-type casing which rests on the ground, or a number of fixed panels which, in combination with the walls of the room in which the tub is installed, form a fixed skirt around the tub 10. In any event, the casing is provided with an inner opening in which the tub is to be inserted, and defines a fixed casing inner peripheral edge portion 16. The casing can be characterized as an anchor element having a flat horizontal raised wall having top and bottom flat wall surfaces and a free edge portion, as shown in the drawings, although the tub could be attached to a casing having a different configuration, including a discontinuous, inwardly oriented flange.

Tub 10 further comprises a base 18 located under the flooring of tub 10, which supports tub 10 over the ground G.

Figure 2:
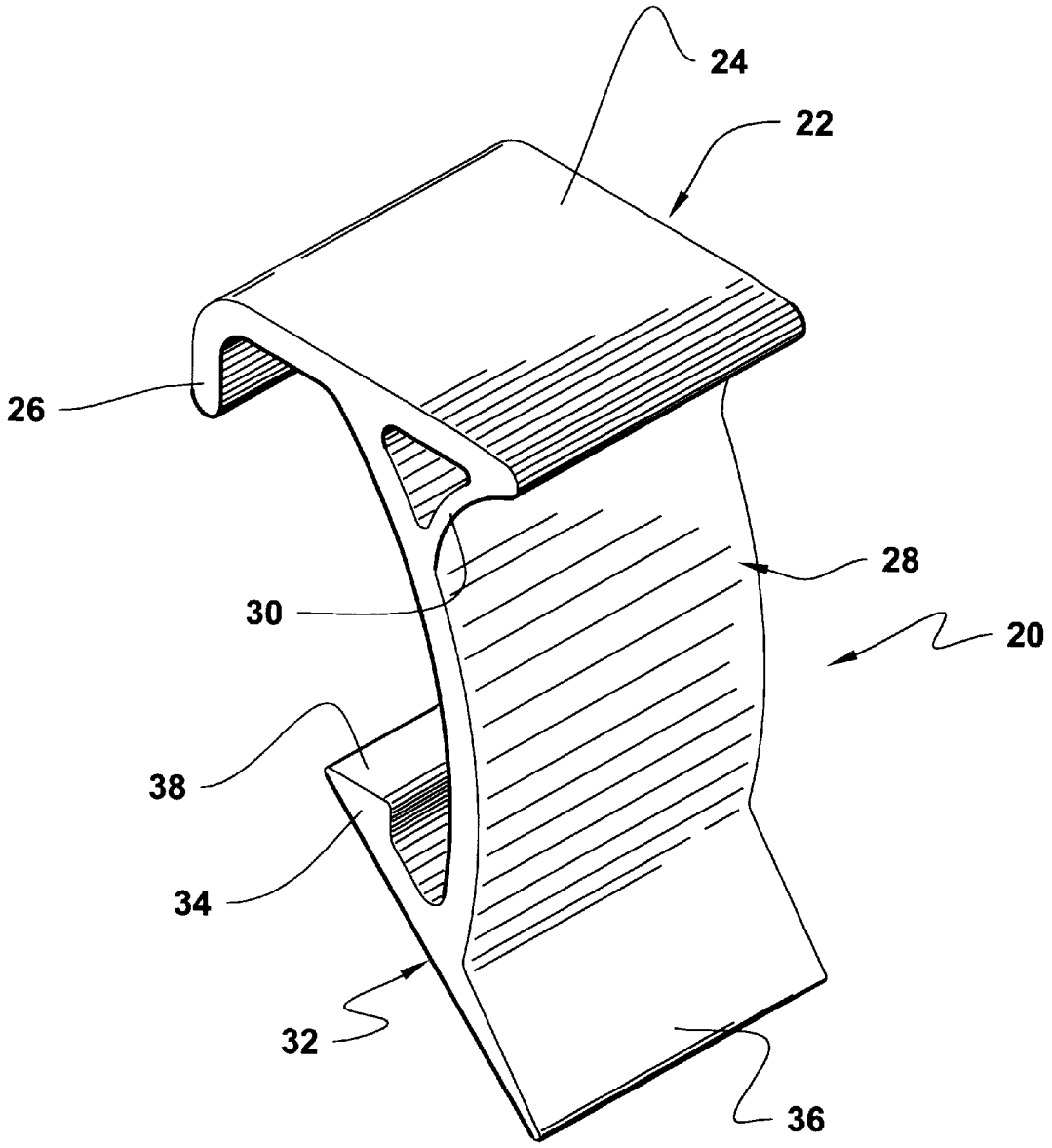
FIG. 2 is a perspective view of a bracket according to the invention, at an enlarged scale.

The invention particularly relates to a connector element or bracket 20 for attaching the tub 10 to the casing peripheral edge portion 16. A number of spaced-apart brackets 20 are disposed along the peripheral rim 14 of tub 10, in a manner described hereinafter. Bracket 20, shown in FIG. 2, comprises an elongated rigid head portion 22 having a flat upper plate 24 which is elbowed to form a short downwardly projecting flange 26. On the underface of head portion 22 and near the intermediate part thereof, is integrally attached a downwardly depending resilient arcuate main body 28 which is further linked to head portion 22 by a short rearwardly extending reinforcement plate 30 integrally attached to both head portion 22 and main body 28. Reinforcement plate 30 provides an enhanced rigidity to head portion 22, to prevent deformation of head portion 22 and of main body 28 near head portion 22. Thus, the relatively short length of head portion 22, in combination with the closed triangular configuration formed by flat upper plate 24, reinforcement plate 30 and the upper root of main body 28, confers a significant rigid head portion 22.

Figure 3:
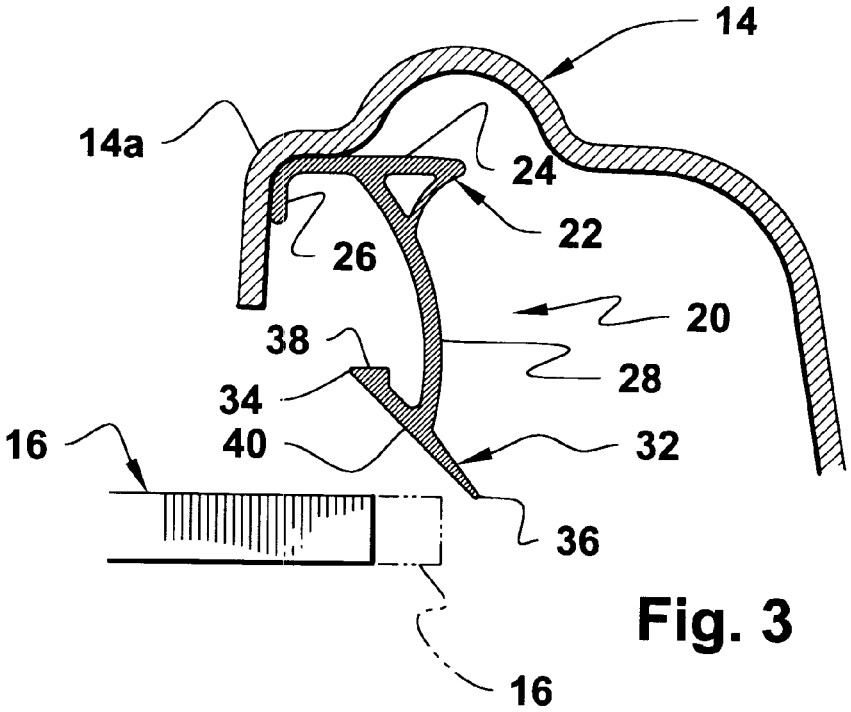
FIGS. 3 and 4 are enlarged cross-sectional views of the area IV in FIG. 1, sequentially showing the bracket in released and attached positions, respectively, with FIG. 4 moreover suggesting in phantom lines an alternate deformed condition of the resilient body of the bracket, suggesting that this body can self-compensate for dimensional differences of the fixed casing resulting from construction plays.
Figure 4:
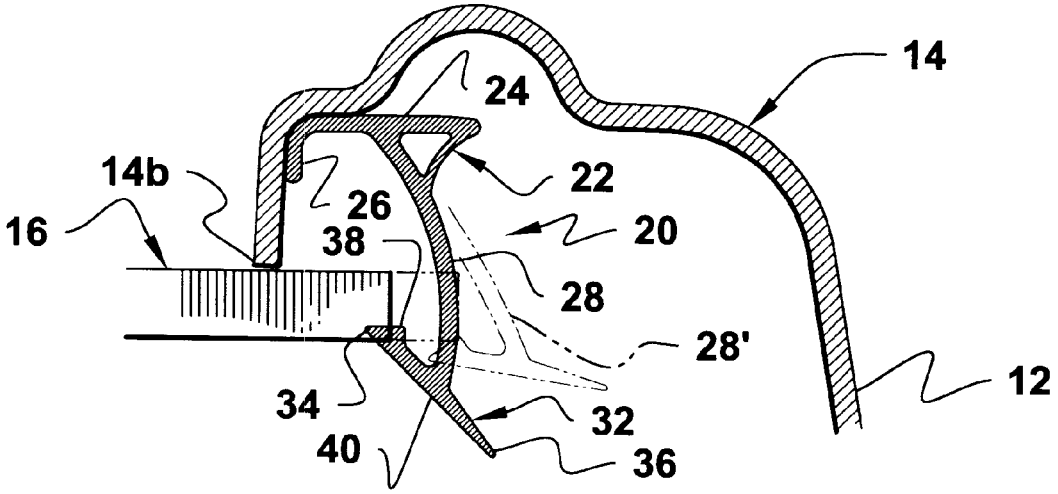

Main body 28 carries at its lower end a rigid elongated foot 32 which has an upper free tip portion 34 and an opposite downwardly extending tail 36. Free tip portion 34 has an upper flat face 38. As seen in FIGS. 3 and 4, foot 32 defines a lower, inclined, elongated, flat abutment surface 40 opposite main body 28.

In use, as shown in FIGS. 3 and 4, bracket 20 is to be attached to the underface of the bathtub peripheral rim 14. The upper face 24 and flange 26 of head portion 22 complementarily engage the elbowed portion 14*a* of rim 14, bracket 20 being fixed in this manner in any suitable way, e.g. with glue. In this position, foot 32 exteriorly and upwardly extends with its free tip portion 34.

To install tub 10 inside the fixed inner peripheral edge portion 16 of the casing, a number of spaced-apart brackets 20 according to the invention are snugly fitted and attached along the concave underface of the tub peripheral rim 14. Once this is done, tub 10 is positioned over the casing opening and is lowered therein with each bracket 20 eventually engaging the casing peripheral edge portion 16 with foot 32. The downward displacement of tub 10 results in the bracket foot abutment surface 40 slidingly abutting against the casing peripheral edge portion 16. This is allowed by a resilient deformation of main body 28, the latter yieldingly bending under the load of the downwardly moving tub 10, to allow the foot free tip portion 34 to move gradually around the casing peripheral edge portion 16. Once free tip portion 34 vertically downwardly clears the casing peripheral edge portion 16, the resiliency of main body 28 will allow foot 32 to be released into a position in which its free tip portion 34 is located under the casing peripheral edge portion 16, as shown in FIG. 4. Simultaneously, the bathtub rim 14 downwardly abuts at 14*b* onto the casing peripheral edge portion 16. In this position, the casing peripheral edge portion 16 is effectively wedged between the bathtub rim 14 downwardly resting on the casing peripheral edge portion 16, and the foot free tip portion 34 upwardly resiliently abutting against the casing peripheral edge portion 16 with its flat tip face 38.

It can be seen that head portion 22, main body 28 and foot 32 form a jaw member sized for through engagement therein of a section of the casing peripheral edge portion 16. The friction fit engagement of foot 32 under peripheral edge 16 prevents vertical dispalcement of tub 10, and simultaneously frictionally helps prevent horizontal displacement of tub 10. Horizontal abutment of main body 28 against casing 16, although not necessary, helps to further secure bathtub 10 in casing 16.

The resiliency of main body 28 compensates for any accidental relative positional misadjustments between bracket 20 and tub rim 14 which may have occured during the installation of bracket 20 under rim 14. Indeed, if bracket 20 is slightly tilted or misaligned, main body 28 may have to bend slightly more or less to compensate this misalignment, while confering an equally advantageous attachment.

Moreover, and more importantly, the resiliency of main body 28 will compensate constructions plays of the casing peripheral edge portion 16, as suggested in FIGS. 3 and 4. Indeed, the precise inner peripheral dimensions of the casing peripheral edge portion 16 may vary inside certain predetermined accepted constructions plays, resulting in a different position of the peripheral rim 14 relative to the casing peripheral edge portion 16' of different dimensions, as shown in phantom lines in FIGS. 3 and 4. In this latter case, the tub-retaining position of foot 32 would be different, for example main body 28' would remain in a position closer to the tub main body 12 as shown in phantom lines in FIG. 4, while still accomplishing its attachment purpose. Considering that the construction of a bathtub casing may be done manually during the bathroom construction, construction plays are likely to be significant and thus a bracket accomodating these construction plays is highly desirable, or even essential.

By contrast, the brackets of the prior art devices known to applicant do not offer such a versatile play adjustment, by providing a main body resiliently mounted to a rigid head portion, with the main body being provided with a foot that can engage the underface of the casing peripheral edge portion.

The arcuate shape of main body 28 prevents same from bending in the wrong direction, i.e. outwardly relative to tub 10, upon abutment of foot 32 on the casing peripheral edge portion 16.

The fact that the flat underface 40 of foot 32 extends from free tip portion 34 down to tail 36, helps to confer a smooth sliding engagement of the foot abutment underface 40 on the casing peripheral edge portion 16, while the tub 14 is lowered and aligned into the casing opening.

The bathtub 10 can thus be attached to its casing in a simple manner, without requiring tedious alignment of the tub relative to the casing, since the different brackets 20 cooperate to guide the tub 10 into the casing opening with their respective inwardly and downwardly inclined foot abutment surfaces 40 which substantially simultaneously engage the casing peripheral edge portion 16. The end result is aesthetically advantageous, since all the brackets 20 are concealed, partly by the tub rim 14 and partly by the casing peripheral edge portion 16, due to the rim 14 resting on the casing 16.

It is thus understood and seen from FIGS. 1 to 4, that the foot 32 is attached to the main body 28 in an inclined fashion, so as to form an acute angle between the foot free tip portion 34 and the front, concave surface of main body 28 and an obtuse angle between the foot tail 36 and the rear convex surface of the main body 28.

Any modifications, which do not deviate from the scope of the present invention, are considered to be included therein. For example, the precise shape of the bracket 20 could vary slightly without departing from the scope of the invention. Indeed, the arcuate main body 28 of bracket 20 could be alternately straight, while still being operatively resiliently deformable. Also, the foot member 32 could be devoid of its tail 36, while still being slidingly abuttable onto the casing peripheral edge portion 16.

It is also envisioned that the foot 32 be manually forcibly deformed, instead of being deformed by its self-abutment on the casing peripheral edge portion 16, to be subsequently manually released once tip portion 34 is located under the casing peripheral edge portion 16. Of course, this can only be done if manual access can be gained under the casing peripheral edge portion 16. This is not the preferred way to carry out the invention, but it could circumvent the necessity to provide a sliding abutment underface on bracket 20.

I claim:

1. A bathtub bracket for use with a bathtub of the type including a flooring and an integral peripheral generally upright wall with a top out-turned and down-turned arcuate rim portion defining a downwardly concave trough, the bathtub being destined to be attached through the instrumentality of said bracket to an adjacent fixed flat horizontal raised wall from a casing element, the horizontal raised wall of the type having a free edge portion and top and bottom horizontal wall surfaces, said bracket comprising:

a rigid elongated head, having a top surface of a shape complementary to that of the bathtub trough and destined to snugly fixedly engage the bathtub arcuate rim portion in the trough;

a rigid elongated foot having a free tip portion and a tail end portion opposite said free tip portion, said foot further having an intermediate portion located spacedly between said free tip and tail end portions, and a flat and straight lower surface extending from said free tip portion to said tail end portion; and a resilient arcuate main body defining an upper end integrally attached to said head and a lower end integrally attached to said foot intermediate portion for resiliently spacedly linking said head portion to said foot, said main body further defining a concave front surface and a convex rear surface;

wherein said foot is attached to said main body in an inclined fashion relative to said main body so as to form an acute angle between said foot tip portion and said main body front concave surface and an obtuse angle between said foot tail end portion and said main body rear convex surface; and wherein a jaw member is defined between said head portion and said foot free tip portion, said jaw member being sized for through engagement therein of a section of the casing wall free edge portion with deformation of said resilient main body yieldingly under concurrent abutment of both said bracket head against the bathtub rim portion and said bracket foot tip portion against the casing wall bottom wall surface, for resilient positive interlock between the bathtub rim and the casing wall, with said foot allowing positive guiding and positional auto-adjustment of the bathtub during installation thereof in the casing element, by the sliding abutment of said foot flat lower surface against the casing wall edge portion, and with said resilient main body resiliently yielding to compensate for dimensional plays of the tub relative to the casing.

2. In combination, a bathtub and a bathtub bracket, said bathtub including a flooring and an integral peripheral generally upright wall with a top out-turned and down-turned arcuate rim portion defining a downwardly concave trough, said bathtub being destined to be attached through the instrumentality of said bracket to an adjacent fixed flat horizontal raised wall from a casing element, the horizontal raised wall of the type having a free edge portion and top and bottom horizontal wall surfaces, said bracket comprising:

a rigid elongated head, having a top surface of a shape complementary to that of said trough and snugly fixedly engaging said bathtub arcuate rim portion in said trough;

a rigid elongated foot having a free tip portion and a tail end portion opposite said free tip portion, said foot further having an intermediate portion located spacedly between said free tip and tail end portions, and a flat and straight lower surface extending from said free tip portion to said tail end portion; and a resilient arcuate main body defining an upper end integrally attached to said head and a lower end integrally attached to said foot intermediate portion for resiliently spacedly linking said head portion to said foot, said main body further defining a concave front surface and a convex rear surface;

wherein said foot is attached to said main body in an inclined fashion relative to said main body so as to form an acute angle between said foot tip portion and said main body front concave surface and an obtuse angle between said foot tail end portion and said main body rear convex surface; and wherein a jaw member is defined between said head portion and said foot free tip portion, said jaw member being sized for through engagement therein of a section of the casing wall free edge portion with deformation of said resilient main body yieldingly under concurrent abutment of both said bracket head against the bathtub rim portion and said bracket foot tip portion against the casing wall bottom wall surface, resilient positive interlock thus occurring between the bathtub rim and the casing wall, with said foot allowing positive guiding and positional auto-adjustment of said bathtub during installation thereof in the casing element, by the sliding abutment of said foot flat lower surface against the casing wall edge portion, and with said resilient main body resiliently yielding to compensate for dimensional plays of said tub relative to the casing.

3. The combination as defined in claim 2, wherein said bracket head is glued to said bathtub arcuate rim portion in said trough.

* * * * *